US005839245A

United States Patent [19]

Behling

[11] Patent Number: 5,839,245

[45] Date of Patent: Nov. 24, 1998

[54] WALLBOARD ANCHOR SYSTEM

[75] Inventor: Thomas C. Behling, Elkhart, Ind.

[73] Assignee: Alpha Systems, Inc., Elkhart, Ind.

[21] Appl. No.: 324,108

[22] Filed: Oct. 14, 1994

[51] Int. Cl.[6] ..... E04C 2/34

[52] U.S. Cl. ..... 52/481.1; 156/91

[58] Field of Search ..... 52/481.1, 488.1; 156/91, 306.3

[56] References Cited

U.S. PATENT DOCUMENTS

| | | | |
|---|---|---|---|
| 4,018,020 | 4/1977 | Sauer | 52/481.1 X |
| 4,069,640 | 1/1978 | Dawdy | 52/481.1 X |
| 4,757,663 | 7/1988 | Kuhr | 52/481.1 |
| 5,052,164 | 10/1991 | Sandow | 52/481.1 X |

FOREIGN PATENT DOCUMENTS

| | | | |
|---|---|---|---|
| 169058 | 12/1981 | Japan | 156/91 |

*Primary Examiner*—Carl D. Friedman
*Assistant Examiner*—W. Glenn Edwards
*Attorney, Agent, or Firm*—Baker & Daniels

[57] ABSTRACT

A wall system and method of manufacturing a wall for a manufactured building is disclosed including gluing a wallboard to a frame made from perimeter plates and stud members. After the wallboard is glued to the frame, an elongate rigid rail member is removably attached to the board to hold the board and frame together during glue set up and curing. The rail member is removed after the glue has cured.

6 Claims, 3 Drawing Sheets

WALLBOARD ANCHOR SYSTEM

BACKGROUND OF THE INVENTION

The present invention relates generally to transportable manufactured buildings, and, more particularly, to a method of manufacturing the walls for the building.

Prior walls and wall systems within transportable manufactured housing or building comprise a wooden frame usually made from 2×4's framed into a rectangular shape to create a strong supporting structure. Plaster, drywall or gypsum boards are attached to the frame by means of fasteners such as staples, nails or other hammered fasteners along the entire outside edge of each of the wallboards. This process uses a large amount of staples or fasteners on the edges, particularly the long edges along the wallboard/stud interface. Additional fasteners are used through the wallboards into the studs located centrally behind the boards.

The prior art method of constructing the walls described above requires a large amount of labor to finish the walls using common finishing materials such as spackling mud or drywall tape. Use of fasteners such as staples or nails increases the chances of marring the face surface of the board during construction.

SUMMARY OF THE INVENTION

The present invention overcomes the aforementioned problems and disadvantages and reduces the chances of marring the face surface of the wallboard by gluing the wallboard to the frame and studs.

Generally, the invention provides a method of gluing a wallboard such as gypsum or drywall to a frame and using a removable rail member to temporarily press or clamp together the board and frame members. After the glue sets, the rail is removed and the completed wall may be used in finishing of the manufactured building.

More specifically, the invention provides a rail member having a channel through which a fastener such as a screw passes so that the rail member is removably attached to the wallboard and frame members. Normally, the rail member is attached transversely relative to the studs; with the screw passing through the joint between the wallboard members and into the underlying stud.

An advantage of the wallboard anchor system of the present invention is its speed of assembly and the reduction in the use of staples or fasteners connecting the wallboard to the frame and stud members. Staple use along the abutting or joint edges of the wallboard has been eliminated.

Yet another advantage of the wallboard anchor system and method of the present invention is that it reduces the amount of finishing labor and materials such as drywall tape, mud or plaster in fixing incidental marring, scratching or indentations caused by the staples or hammered fasteners used in the prior art method. The location of the rail screws through the joints between the boards does not increase the amount of finishing necessary since the joints between the wallboard have to be finished in all cases.

The invention, in one form thereof, provides a wall for a transportable, manufactured building having a rectangular frame having opposite sides and stud members connected between the opposite sides of the frame. Wallboard is attached to the stud members by glue spread between the wallboard and the studs. A rail is connected to the wallboard and into the studs to hold the wallboard and studs together during glue set up. The rail is removed when the glue has set. The rail is preferably oriented transverse to the studs.

The invention, in one form thereof, provides a wall system for a transportable manufactured building, the wall system having a rectangular frame with a plurality of parallel studs extending from one side of the frame to the opposite side. Curable glue is applied and disposed between the studs and the wallboard to attach the wallboard to the studs before the wallboard is tacked to the frame. Wallboard, each having a top edge and a bottom edge, are tacked to the frame at their top and bottom edges by using staples or similar fasteners. A rail member is removably attached through each of the wallboard to at least two of the studs, the rail member being attached to the wall during glue curing and detached from the wall after the glue cures.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
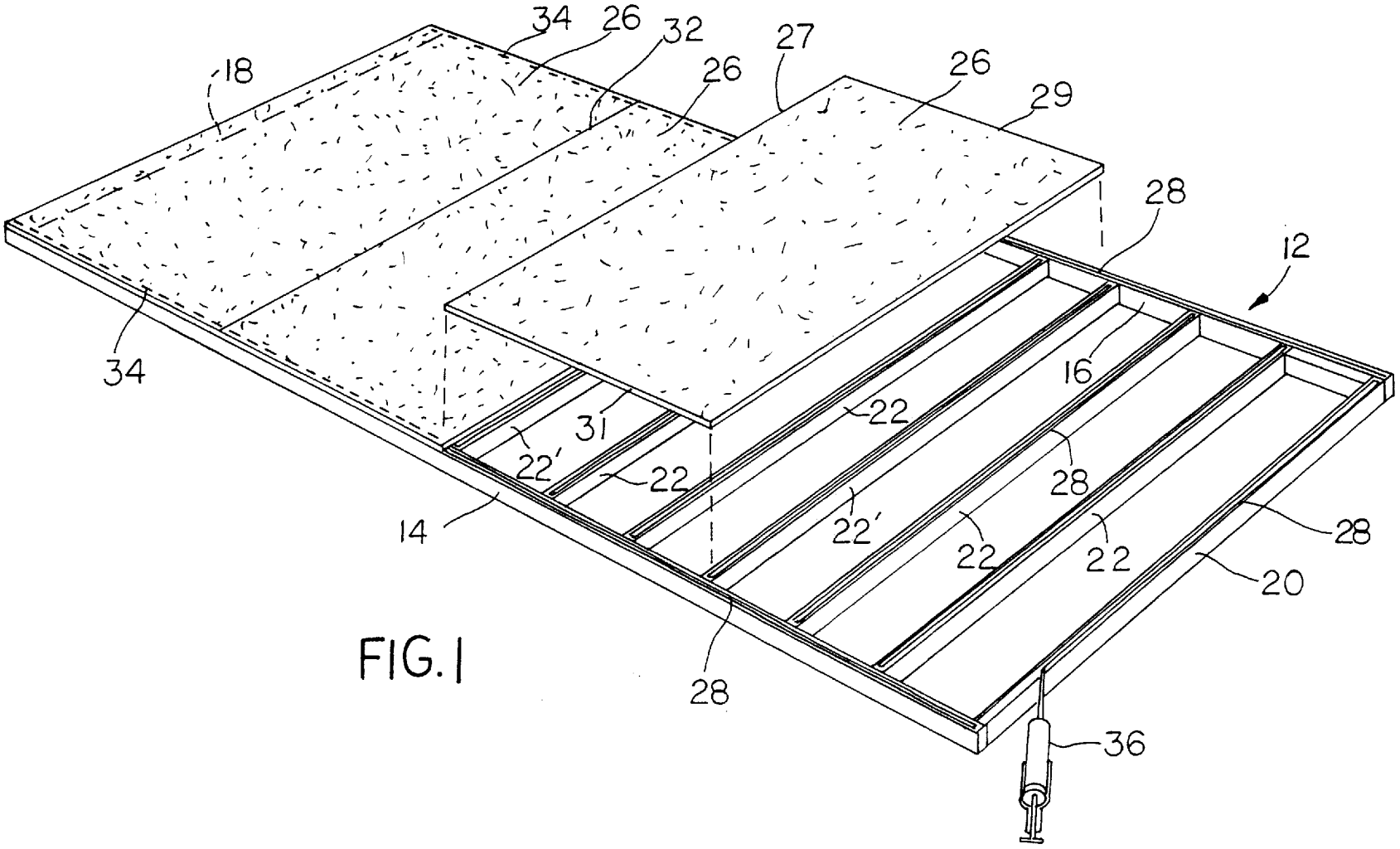
FIG. 1 is a perspective view of a wall made pursuant to the present invention.

Referring now to the drawings, a wall 10 for transportable manufactured buildings is shown. Wall 10 includes a rectangular frame 12. As known in the art, rectangular frame 12 may be formed from wooden plate members such as 2×4's and includes bottom plate member 14, and top plate member 16. Side studs 18 (hidden) and 20, and a plurality of intervening studs 22 are attached between top plate 16 and bottom plate 14. Studs 18, 20 and 22 are normally attached parallel to one another to create a strong supporting framework. As known in the art, 2×3 backer plates 24 may be attached to the corners of frame 12 to assist in attaching wall 10 to other portions of the transportable manufactured building (not shown).

At least one wallboard section 26 having an inner surface 60 and an outer surface 62 is then attached to frame 12. Normally, gypsum boards are utilized as wallboard sections 26, although other types of wallboard, such as typical drywall or plywood and others may be equivalently utilized. Wallboard section 26 each include side edges 27, a top edge 29 and a bottom edge 31.

The method for manufacturing wall 10 includes providing a rectangular frame 12 and applying glue 28 to the top surfaces of studs 18, 20 and 22 and top and bottom plates 16 and 14. As shown in FIG. 1, a glue applicator 30 may be utilized for the glue application step. Preferably, the glue is applied to plates 14, 16 and studs 18, 20 and 22 in a two bead format as shown in FIG. 1. Two parallel spaced apart glue beads of approximately 1/16" diameter are applied to the members of frame 12. This particular sizing of glue application increases the final strength of the glue bond with wallboard 26 while further assuring that each side edge 27 of wallboard 26 is in contact with at least one glue bead when wall 10 is assembled. Glue 28 is preferably a one component polyurethane resin glue having enhanced adhesion qualities such as Pemco 5100 available from Alpha Systems of Elkhart, Ind. After the gluing step, wallboard sections 26 are placed at their inner surfaces 60 into contact (i.e., assembled) with both studs 18, 20 and 22 and plates 14, 16 in such a manner that the wallboards align with bottom and top plates 14 and 16. At this time, wallboard sections 26 may be tacked to plates 14, 16 by means of a plurality of fasteners 34 such as staples or nails, as is known in the art.

After the wallboard sections 26 are tacked to frame 12, one or more rail members 40 are attached across the wallboard sections at their outer surfaces 62 and are fastened into studs 18 and 20 and underlying seam studs 22'. Rail members 40 are utilized to press or clamp wallboard sections 26 to studs 18, 20 and 22 including 22' and plates 14, 16 to increase the strength of the glue bond therebetween. Although rail members 40 may be attached to studs 18, 20 and 22' in any relative orientation, preferably, rail members 40 are attached transverse to studs 18, 20 and 22' to evenly spread the clamping force developed. Depending on the height of the wall, more than one rail member 40 may be utilized. Rail members 40 are typically spaced apart 18 to 28 inches from each other and from top and bottom plates 14 and 16, to evenly press or clamp wall 10 together.

Figure 3:
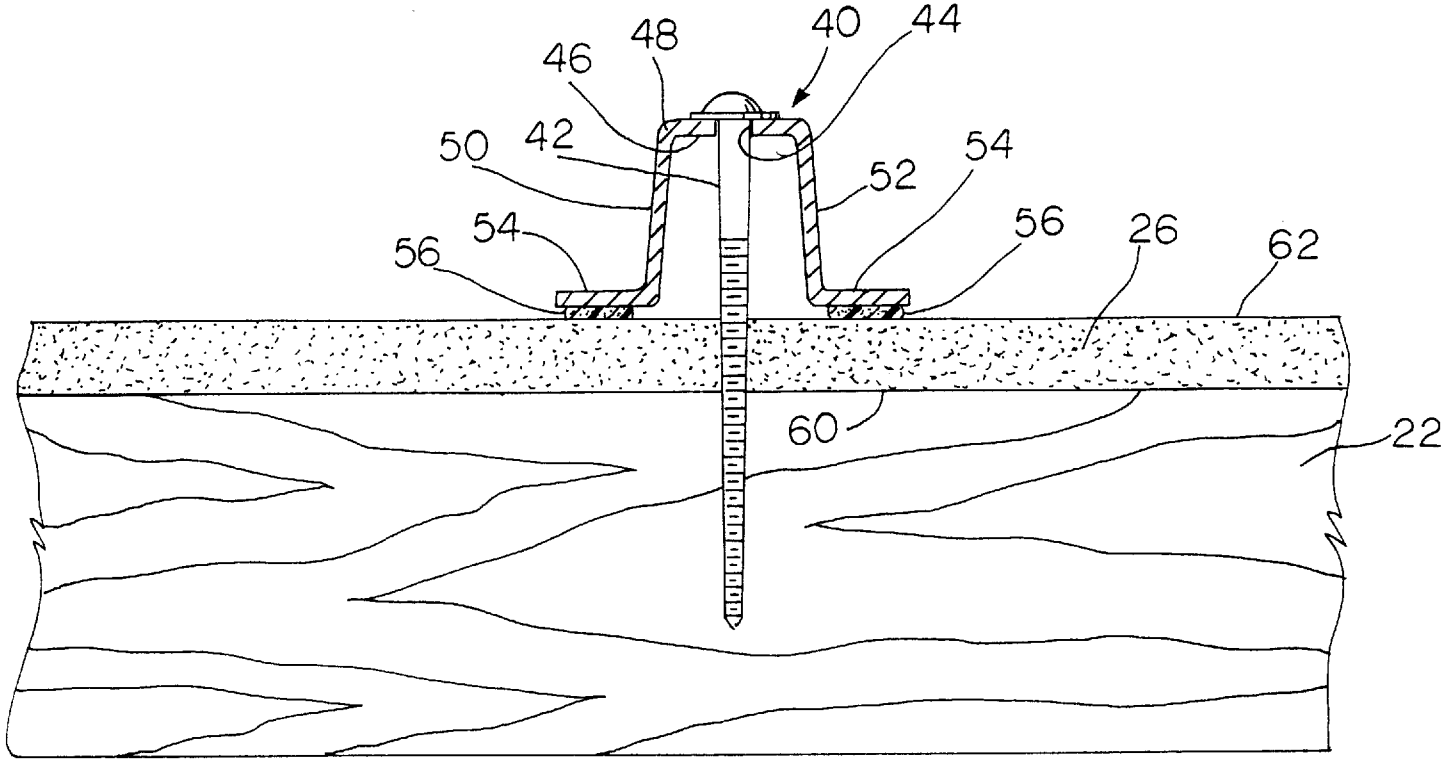
FIG. 3 is an enlarged, cross-sectional view taken substantially along lines 3—3 of FIG. 2.

As shown in FIG. 3, rail member 40 is removably attached to studs 18, 20 and 22' by means of a removable fastener such as screw 42 which passes through a bore 44 in rail 40. Rail member 40 may include a substantially U-shaped channel formed from an elongate top portion 48 having elongated side portions 50 and 52. Each side portion 50, 52 includes an opposite outwardly extending leg portion 54. As shown in FIG. 3, a resilient, elongated cushion 56 is attached to each elongated leg portion 54 to prevent marring the outer surface of wallboard sections 26. Resilient cushion 56 is formed of rubber or foam material to prevent scuffing or marring of wallboard 26. The shape of rail member 40 creates a biasing force between wallboard sections 26 and all studs 22 and 22' after screws 42 are installed. During attachment, each screw 42 is threaded through the joint between adjacent wallboard section 26 and into a stud 22' or through the edge of the sides of the wallboard sections defining the ends of the wall and into side studs 18 or 20. Side portions 50 and 52 slightly separate thereby causing rail member 40 to act as a spring maintaining bias force between wallboard sections 26 and studs 22 and 22' during the curing of glue 28.

Figure 2:
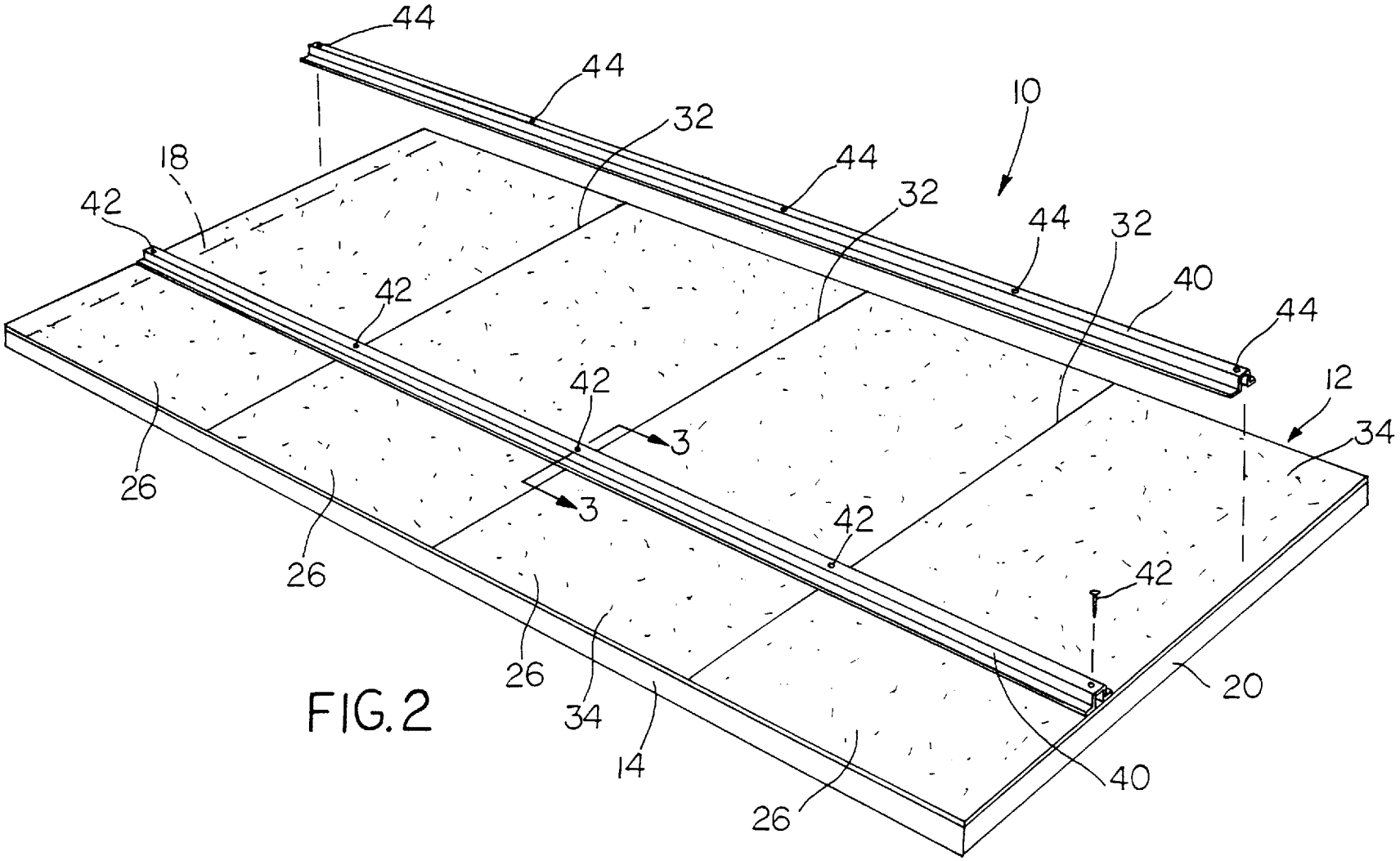
FIG. 2 is a perspective view of the wall of FIG. 1 showing attachment of the rail member.

As shown in FIG. 2, along with the transverse attachment of rails 40 relative to studs 22, screws 42 are preferably located along the seams or joints 32 between wallboard sections 26. This location of screws 42 further reduces the amount of finishing work necessary for wall 10 since joints 32 between wallboard sections 26 always require finishing. After glue 28 has cured or set, rail member 40 is removed from wall 10 by removing screws 42 from studs 18, 20, 22'. Rails 40 may be removed prior to or after the wall 10 is set upon its flooring. After rail 40 is removed from wall 10, standard finishing operations such as mudding or taping are accomplished.

The present method and system reduces the occurrence of marring or scuffing wallboard section 26 by reducing the amount of fasteners such as staples or finishing nails along the edges and surface of wallboard sections 26.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of manufacturing a wall for a manufactured building, said method comprising:

providing a rectangular frame having opposite plate members and studs extending between said plate members;

applying glue to said studs and said plate members;

placing wallboard in contact with said glue applied to said studs and plate members;

attaching a rigid rail to said studs to overly and in contact with the wallboard to urge said wallboard against said studs as said glue cures; and removing the rail when said glue has set.

2. The method of claim 1, including the step of attaching said rail to said wallboard transversely to said studs.

3. The method of claim 1 in which said rail is attached to said studs by screws.

4. The method of claim 1 in which said wallboard is of multiple sections defining joints therebetween, said method including the step of attaching said rail to said studs through said joints.

5. The method of claim 1 in which said glue comprises polyurethane.

6. The method of claim 1, including the step of attaching another said rail to said studs.

* * * * *